US006543074B1

(12) United States Patent
Wunderlich

(10) Patent No.: US 6,543,074 B1
(45) Date of Patent: Apr. 8, 2003

(54) SPINNER BASKET HAVING LABYRINTH RING AND METHOD FOR USING SAME

(75) Inventor: Daniel F. Wunderlich, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/992,801

(22) Filed: Nov. 13, 2001

(51) Int. Cl.[7] ..... D06F 23/06

(52) U.S. Cl. ..... 8/158; 8/159; 68/23.4; 68/58; 68/208

(58) Field of Search ..... 8/158, 159; 68/23.4, 68/58, 208

(56) References Cited

U.S. PATENT DOCUMENTS 2,296,257 A 9/1942 Breckenridge
2,615,320 A 10/1952 Belaieff
4,468,938 A 9/1984 McMillan
4,941,333 A 7/1990 Blessing
4,949,557 A * 8/1990 Price ..... 68/23.4
5,526,657 A 6/1996 Johnson
5,711,170 A 1/1998 Johnson
5,829,277 A 11/1998 Wunderlich

* cited by examiner

*Primary Examiner*—Philip R. Coe
(74) *Attorney, Agent, or Firm*—McKee, Voorhees & Sease, P.L.C.

(57) ABSTRACT

A washing appliance includes a spinner basket having a curved labyrinth ring around its outer surface. The labyrinth ring blocks water from leaving the spinner basket during the washing cycle wherein the basket spins in a first direction. The labyrinth ring permits water to exit the spinner basket when it is rotating in the opposite direction during its spinning cycle.

8 Claims, 2 Drawing Sheets

SPINNER BASKET HAVING LABYRINTH RING AND METHOD FOR USING SAME

BACKGROUND OF THE INVENTION

This invention relates to a spinner basket having a labyrinth ring and method for using same.

Conventional clothes washing appliances utilize an inner basket having perforations therein and an outer basket or tub surrounding the inner basket. The washing fluid communicates with the outer tub through the perforations in the inner basket. This construction adds to the cost of the appliance because it requires both an outer tub and an inner basket. It also adds to the amount of heated water required and therefore uses a considerable amount of water and energy.

Therefore a primary object of the invention is the provision of an improved spinner basket having a labyrinth ring thereon and a method for using same.

A further object of the present invention is to provide an appliance that provides an optimum usage of water.

A further object of the present invention is the provision of an improved spinner basket that provides an optimum usage of energy to heat water.

A further object of the present invention is the provision of an appliance having a spinner basket that contains the water during the washing cycle, but which permits the water to drain from the spinner basket during the spin cycle.

A further object of the present invention is the provision of an improved spinner basket having a labyrinth ring which eliminates the need for a boot seal on the door of the appliance in order to seal the opening of the appliance.

A further object of the present invention is the provision of a spinner basket having a labyrinth ring that is efficient in operation, durable in use, and less expensive to manufacture.

BRIEF SUMMARY OF THE INVENTION

The foregoing objects may be achieved by a washing appliance having a spinner basket defining a basket cavity for holding a quantity of water and being mounted within the appliance for rotation about a non vertical spinner access. The spinner basket has a curved labyrinth ring extending around the outside of the spinner basket and positioned to rotate around the spinner access when the spinner basket is rotating. The labyrinth ring has a plurality of elongated curved labyrinths therein. Each of the labyrinths has a first end provided with an inlet opening providing communication from the basket cavity into the labyrinth. Each of the labyrinths also has an opposite second end with an outlet opening providing communication from the labyrinth to the exterior of the spinner basket.

A drive mechanism is connected to the spinner basket for rotating the spinner basket in a first rotational direction with the inlet openings trailing the outlet openings of each of the labyrinths. During rotation in this first rotational direction the quantity of water does not exit the outlet openings of the labyrinth.

The drive mechanism is capable of rotating the spinner basket in a second direction opposite from the first direction. When spinning in the second direction the quantity of water enters each of the labyrinths through the inlet openings and exits each of the labyrinths through the outlet openings to the exterior of the spinner basket.

Utilizing this construction minimizes the need for an outer tub, and requires only that there be a drain cavity for receiving the water exiting from the labyrinth ring during the spin cycle. Furthermore, it eliminates need for a boot seal between the door opening of the appliance and the outer tub or support wall.

DETAILED DESCRIPTION OF THE INVENTION

Figure 1:
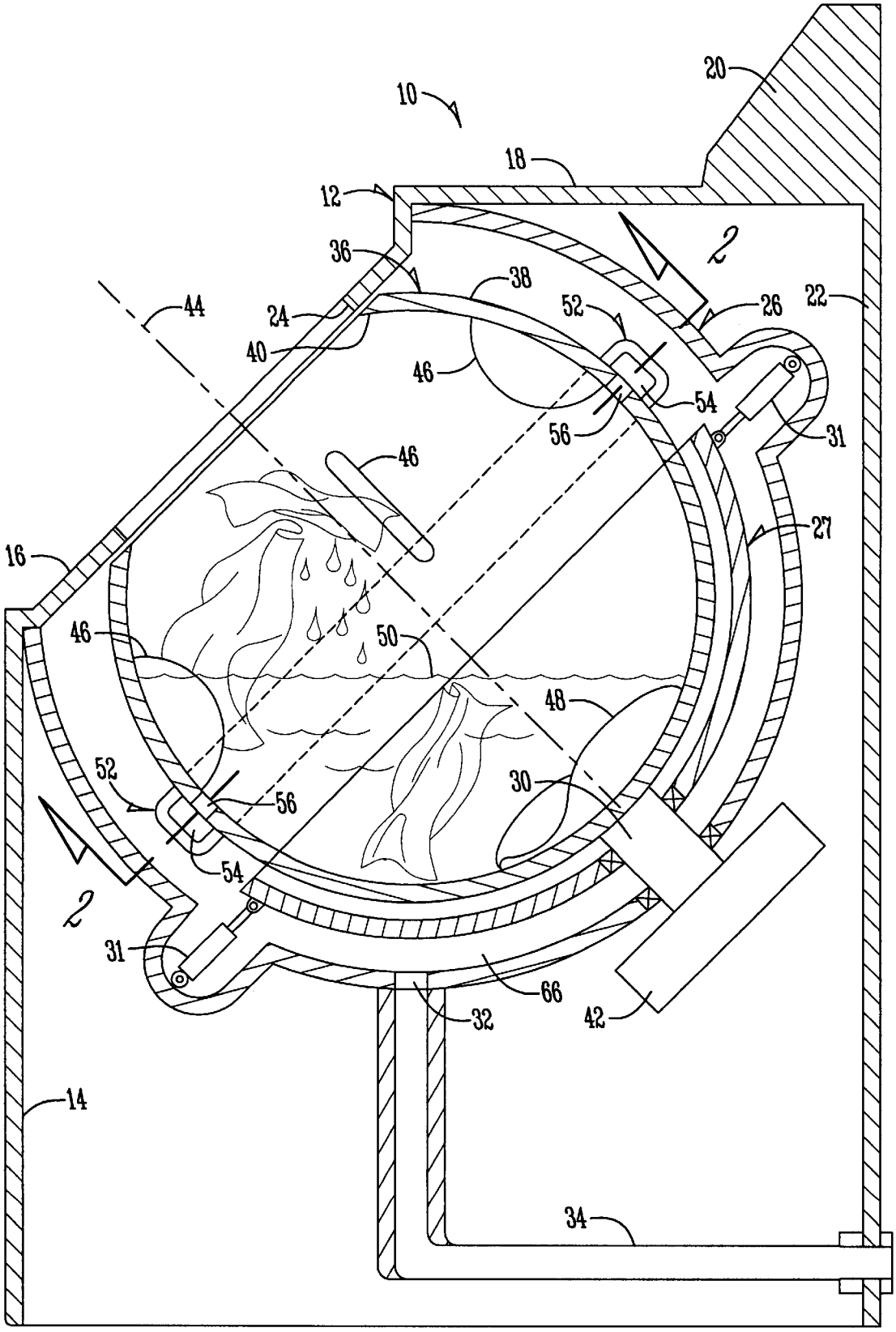
FIG. 1 is a sectional view of a washing appliance utilizing the spinner basket and labyrinth ring of the present invention.

Referring to FIG. 1, an appliance 10 includes an outer cabinet 12 comprising a front lower wall 14, a front upper wall 16, a top wall 18, a console 20 and a rear wall 22. An access opening 24 is provided in the upper front wall 16. The access opening 24 is shown without a door mounted over it, but such a door would normally be provided.

Within cabinet 12 is a support wall 26, rigidly attached within cabinet 12 by conventional means (not shown). Support wall 26 is concave in shape and forms an enclosed drain cavity 66. A drain opening 32 is provided in the lower most portion of lower support frame 26 so as to drain any water contained within drain cavity 66 outwardly through a drain conduit 34.

Mounted within the drain cavity 66 is a spinner basket 36. Spinner basket 36 is shown to have a spherical wall 38. However, it is also possible for the spinner basket 36 to have other configurations such as a cylindrical configuration with cylindrical side walls and a flat bottom wall, or other types of configurations. A hemispherical wall 27 surrounds the lower half of spinner basket 36 and is held in place by struts 31. Spinner basket 36 includes at its upper end an access opening 40. Motor 42 is connected to the bottom of the spinner basket by a shaft 30 for rotating the spinner basket in conventional fashion. Motor 42 is shown only schematically, but there are many different types of motors available commercially which cause the spinner basket 36 to rotate in one direction to cause a tumbling action and washing of the materials within the spinner basket 36, and rotate in the opposite direction for spinning the fabrics within the spinner basket to remove moisture from them. Spinner basket 36 is adapted to rotate about a rotational axis 44 which is shown in the drawings to be approximately 45 degrees, but which can be varied substantially. Preferably it is not vertical.

Within the spinner basket 36 are a plurality of tumbling paddles, and at the bottom of the spinner basket 36 is a helical ridge 48. Helical ridge 48 and the paddles 46 cause the fabrics within the spinner basket 36 to move in a tumbling action during the washing cycle so as to clean and wash those fabrics. A quantity of water 50 is provided in the lower most portion of the spinner basket 36 and this water also tumbles and is agitated by the paddles 46 and the helical ridge 48.

Extending around the exterior of the spinner basket 36 is an annular labyrinth ring 52. The labyrinth ring 52 is shown in cross section in FIGS. 2 and 3. It includes hollow walls which create three separate elongated arcuate labyrinths 54. While three labyrinths 54 are shown the number of labyrinths 54 may be increased or decreased without detracting from the invention. These labyrinths 54 are cavities which are capable of containing water. At one end of each cavity 54 is an inlet opening 56 providing communication from the labyrinth 54 to the interior of the spinner basket 36. At the other end of each labyrinth 54 is an outlet opening 58 providing communication from the labyrinth 54 to the exterior of the spinner basket 36. Screens 60 extend over the inlet openings 56 to prevent larger objects from passing through inlet openings 56, but being capable of permitting water to pass through the inlet openings 56.

Labyrinth ring 52 is shown to be located in a single plane, but it could be located in more than one plane. For example it could extend spirally upward from lowest portion of spinner basket 36 toward the openings 56 of spinner basket 36.

Figure 2:
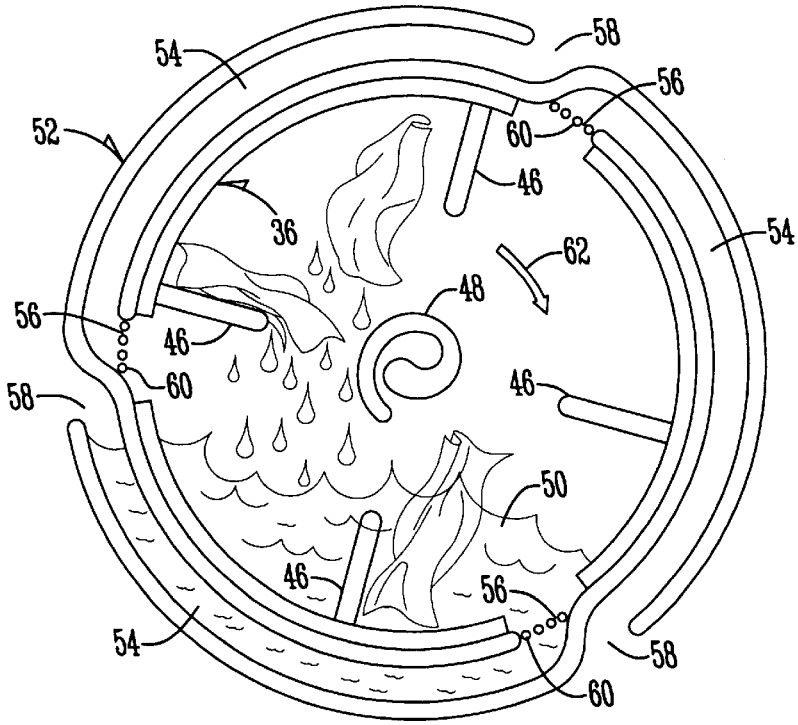
FIG. 2 is a sectional view taken along line 2—2 of FIG. 1.
Figure 3:
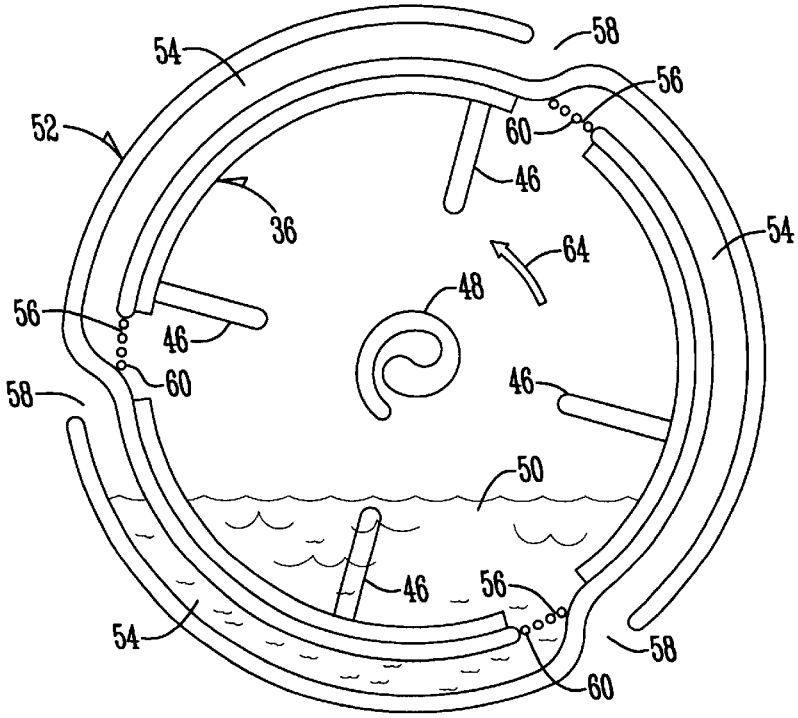
FIG. 3 is a view similar to FIG. 2, but showing the rotation of the spinner basket in the opposite direction.

In operation, the water 50 is placed within the spinner basket 36 at a level comparable to that shown in FIGS. 1–3. It should be noted that the spinner basket of the present invention uses a minimum amount of water as compared to vertical axis washers which must be filled to a much greater depth. After the water 50 has been placed in the spinner basket 36, it remains within that basket while the basket is in a stationary condition. The reason for this is that there are no perforations in the spinner basket 36 as is the case with most conventional spinner baskets. Instead the only openings in spinner basket 36 are the inlet openings 56 which provide communication into the labyrinths 54. When the spinner basket 36 is stationery as shown in FIG. 2, the labyrinths 54 are partially filled with water, but they are incapable of draining water out of the labyrinth through the outlet opening 54.

During the washing cycle the spinner basket 36 is rotated in the direction shown by clockwise arrow 62 in FIG. 2. When rotating in this direction, the water 50 is not permitted to exit through the outlet openings 58. Instead the water fills the labyrinth 54 and as the inlet opening 56 rises on the left side of the rotation of the device, the water drains out of the labyrinth back into the spinner basket. Thus during the washing cycle the water is agitated in a tumbling action but is not permitted to exit through the outlet openings 58. The fabrics within the spinner basket 36 are tumbled and washed.

During the spinning cycle of the spinner basket 36, the motor 42 is reversed so as to rotate the spinner basket in the direction shown by counterclockwise arrow 64 in FIG. 3. When rotating in this direction, the labyrinths 54 act as scoops, scooping the water into each labyrinth 54 through opening 60 and permitting the water to exit through outlet opening 58. While FIG. 3 shows the water 50 resting in the bottom of the spinner basket 36, during rotation of the spinner basket 36 the water is forced by centrifugal force outwardly around the circumference of the inside of the spinner basket 36. However, the water is permitted to exit through the openings 56 into the labyrinths 54 and outwardly through the outlet openings 58.

After the water exits through the outlet opening 58 it enters drain cavity 66 and because of gravity drains downwardly through drain opening 32 into drain conduit 34. The high speed rotation of the spinner basket 36 forces a substantial amount of water out of the fabrics and outwardly through the drain conduit 34.

An important feature of the present invention is that the spinner basket does not have traditional perforations in it which permit the water to flow freely between the drain cavity 66 and the interior of the spinner basket 36. Instead all of the water is contained within the spinner basket 36 while the basket is at rest and while it is in its washing cycle. This reduces the amount of water necessary. In prior devices the amount of water necessary to maintain a proper level within the spinner basket 36 required additional water to fill not only the spinner basket 36 but also to fill the tub surrounding the spinner basket 36 to the same level. In the present invention, only enough water to fill spinner basket 36 to the level 50 is required.

Because the spinner basket uses less water it is also energy efficient because it requires less energy to heat the smaller amount of water.

Another advantage of the present invention is that there is not a requirement for a boot seal between the door opening of the appliance and the outer tub or support wall 26. The water flows by gravity downwardly to the bottom of the spinner basket 36, and it also flows by circumferential force during the spinning cycle toward the labyrinth ring 52. Thus the need for a tight seal around the access opening 40 is minimized.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A washing appliance comprising:

a spinner basket defining a basket cavity for holding a quantity of water and being mounted within said appliance for rotation about a non vertical spinner axis said spinner basket having a curved labyrinth ring extending around the outside of said spinner basket and positioned to rotate around said spinner axis when said spinner basket is rotating;

said labyrinth ring having a plurality of elongated curved labyrinths therein;

each of said labyrinths having a first end provided with an inlet opening providing communication from said basket cavity into said labyrinth and an opposite second end with an outlet opening providing communication from said labyrinth to the exterior of said spinner basket;

drive mechanism connected to said spinner basket for rotating said spinner basket in a first rotational direction with said inlet openings trailing said outlet openings of each of said labyrinths, whereby said quantity of water does not exit said outlet openings of said labyrinth;

said drive mechanism being capable of rotating said spinner basket in a second direction opposite from said first direction, whereby said quantity of water enters each of said labyrinths through said inlet openings and exits each of said labyrinths through said outlet openings to the exterior of said spinner basket.

2. A washing appliance according to claim 1 wherein said inlet openings and said outlet openings within each of said labyrinths are spaced a predetermined distance apart, said quantity of water engaging said spinner basket along a second distance that is equal to or less than said predetermined distance.

3. A washing appliance according to claim 1 wherein said spinner basket includes spherically shaped walls.

4. A washing appliance according to claim 1 wherein said spinner basket is cylindrical in shape and includes a cylindrical side wall and a bottom wall, said labyrinth ring extending around the outside of said cylindrical side wall.

5. A washing appliance according to claim 1 and further comprising a tub having a tub cavity, said spinner basket being mounted within said tub cavity, whereby said quantity of water will pass from said spinner cavity to said tub cavity through said outlet openings of said labyrinths during rotation of said spinner basket in said second direction.

6. A washing appliance according to claim 1 wherein said spinner basket includes spinner basket walls that are free from holes permitting said quantity of water to exit said spinner basket other than said inlet openings that provide communication from said spinner basket into said labyrinths of said labyrinth ring.

7. A washing appliance comprising:

a washing appliance cabinet;

a spinner basket mounted within said appliance cabinet for rotation about a non vertical spinner axis;

said spinner basket having walls defining a spinner cavity, a plurality of water drain holes in said walls of said spinner basket and being positioned in a circular line extending around said spinner axis, said spinner basket walls being free from water drain holes other that those in said circular line;

a labyrinth ring surrounding said spinner basket and registered with said circular line of said water drain holes;

said labyrinth ring having a plurality of labyrinths therein, each of said labyrinths being in communication with one of said water drain holes and having an exit opening spaced a predetermined distance from said one water drain hole;

a water drain being in communication with said exit openings of said labyrinth ring for receiving water therefrom and draining said water from said appliance;

said labyrinth ring blocking the exit of water from said spinner basket when said spinner basket rotates in a first rotational direction and permitting the exit of water from said spinner basket into said drain when said spinner basket rotates in a second rotational direction opposite from said first rotational direction.

8. A method for washing and spin drying fabrics comprising:

placing a quantity of water within a spinner basket adapted to rotate about a non vertical axis, said spinner basket having a labyrinth ring extending around the exterior thereof, said labyrinth ring having a plurality of labyrinths therein, each of said labyrinths having an inlet opening providing communication into the interior of said spinner basket, and an outlet opening providing communication from said labyrinth to the exterior of spinner basket;

placing said fabrics within said spinner basket;

rotating said spinner basket in a first direction for tumbling and washing said fabrics;

using said labyrinth ring to block the exit of said quantity of water from said spinner basket during said rotation of said spinner basket in said first rotational direction;

reversing the rotational direction of said spinner basket to a second rotational direction opposite from said first rotational direction;

using said labyrinth ring to permit said quantity of water to exit said spinner basket during said reversed rotation of said spinner basket in said second rotational direction.

* * * * *